US011489281B2

(12) United States Patent
Xue

(10) Patent No.: US 11,489,281 B2
(45) Date of Patent: Nov. 1, 2022

(54) ANTI-ELECTRIC SHOCK STRUCTURE AND SOCKET

(71) Applicant: Zhenjiang Electrics (Shenzhen) Co., Ltd., Shenzhen (CN)

(72) Inventor: Jingle Xue, Zhumadian (CN)

(73) Assignee: ZHENJIANG ELECTRICS (SHENZHEN) CO., LTD., Shenzhen (CN)

( * ) Notice: Subject to any disclaimer, the term of this patent is extended or adjusted under 35 U.S.C. 154(b) by 0 days.

(21) Appl. No.: 17/463,280

(22) Filed: Aug. 31, 2021

(65) Prior Publication Data

US 2022/0247113 A1 Aug. 4, 2022

(30) Foreign Application Priority Data

Feb. 1, 2021 (CN) ..... 202110136427.4

(51) Int. Cl.

| | |
|---|---|
| ***H01R 13/453*** | (2006.01) |
| ***H01R 13/516*** | (2006.01) |
| ***H01R 24/76*** | (2011.01) |
| ***H01R 13/502*** | (2006.01) |
| ***H01R 13/52*** | (2006.01) |
| ***H01R 13/703*** | (2006.01) |

(52) U.S. Cl.

CPC ..... *H01R 13/4534* (2013.01); *H01R 13/502* (2013.01); *H01R 13/516* (2013.01); *H01R 13/5227* (2013.01); *H01R 13/7033* (2013.01); *H01R 24/76* (2013.01)

(58) Field of Classification Search

CPC ..... H01R 13/4534; H01R 13/502; H01R 13/516; H01R 13/5227; H01R 13/7033; H01R 24/76; H01R 24/78; H01R 2103/00; H01R 13/447; H01R 13/52

See application file for complete search history.

(56) References Cited

FOREIGN PATENT DOCUMENTS

| | | | | |
|---|---|---|---|---|
| CN | 106684614 A | * | 5/2017 | |
| CN | 108539548 A | * | 9/2018 | ..... H01R 13/64 |
| CN | 111628361 A | * | 9/2020 | |
| TW | M406297 U | * | 6/2011 | |

* cited by examiner

*Primary Examiner* — Travis S Chambers

(74) *Attorney, Agent, or Firm* — Chun-Ming Shih; Lanway IPR Services

(57) ABSTRACT

The present disclosure provides an anti-electric shock structure and a socket. In a non-conductive state, the two conductive pieces are respectively arranged in front of the elastic piece parts of the two conductive contact pieces at intervals. A first socket is formed in the jack part. When a plug is plugged into the first socket, one plug blade of the plug extrudes the sliding mechanism to push the two elastic piece parts, so that the two elastic piece parts can touch the conductive pieces. When a non-plug conductive object is inserted into the first socket, the conductive contact pieces cannot conduct electricity because the conductive object cannot push the sliding mechanism to the position where the elastic piece parts are in contact with the conductive pieces, so that the anti-electric shock structure has a good anti-electric shock function.

10 Claims, 7 Drawing Sheets

ANTI-ELECTRIC SHOCK STRUCTURE AND SOCKET

TECHNICAL FIELD

The present disclosure relates to the technical field of sockets, and in particular, to an anti-electric shock structure and a socket.

BACKGROUND

A socket refers to a base into which one or more circuit connections may be plugged, through which various connections can be plugged to facilitate connection with other circuits. A power socket is electrical equipment which provides power interfaces for household electrical appliances, and is also an electrical accessory that is usually used in a residential electrical design, so it has a close relationship with people's life. Current sockets are generally ordinary sockets. This socket typically consists of a shell, and wiring columns and conductive elastic pieces arranged in the shell. For children with low awareness of safety, it is possible to plug iron nails, copper wires, or other conductive objects into jacks of the socket or plug a fingers into the jacks of the socket due to curiosity, which leads to electric shock accidents easily. Since sockets can be seen everywhere, it is difficult to prevent children from being in contact with the sockets, so the electric shock accidents can be prevented only by improving the anti-electric shock performance of the sockets.

In addition, in daily life, the sockets may also be used in places with more water vapor, such as kitchens and bathrooms. Due to the fact that the water vapor is sufficient in these places, and the water vapor can be accumulated in the sockets, even adults with strong safety awareness may have the electric shock accidents when using these sockets with water vapor. In addition, when water flows inside the sockets, the sockets are more likely to be short-circuited to affect the service life of the sockets. Therefore, in general, the anti-electric shock performance and the water resistance of the sockets are the keys for measuring the safety of the sockets.

According to the existing waterproof measures, waterproof boxes are generally configured for power sockets. When the power sockets are not used, the waterproof boxes cover the jacks of the power sockets, so as to prevent water or other liquid from entering the jacks. However, after a plug is plugged into the jacks, the waterproof boxes basically cannot achieve a waterproof effect and affect the plugging and unplugging of the plug, which brings inconvenience to users. In order to solve the problem of electric shock caused by misplug of the sockets, movable baffle plates are generally arranged at outer jacks of some anti-electric shock sockets on the market at present, which prevents harm to people caused by errors and the like. However, plugs are difficultly plugged into and unplugged from these sockets. The plugs are sometimes difficult to plug by people with small force, and the sockets are extremely easily damaged by plugging forcibly.

SUMMARY

An objective of the present disclosure is to provide an anti-electric shock structure and a socket to solve the problems that the socket is difficult to plug and unplug and is inconvenient to use due to the fact that a movable baffle plate is arranged on the anti-electric shock socket in the prior art.

The anti-electric shock socket of the present disclosure can effectively avoid a phenomenon of electric shock caused by misplug, and is convenient to plug. In addition, the socket cannot be short-circuited when there is water entering jacks, and electric energy is saved.

The anti-electric shock structure provided by the present disclosure includes two conductive contact pieces that are arranged oppositely, a sliding mechanism, and conductive pieces corresponding to the two conductive contact pieces. Each conductive contact piece includes a jack part and an elastic piece part. The elastic piece part is connected to the front end of the jack part and can extend to the front of the jack part. In a non-conductive state, the two conductive pieces are respectively arranged in front of the elastic piece parts of the two conductive contact pieces at intervals.

A first socket is formed in the jack part. The front side of the sliding mechanism is pressed against the elastic piece parts of the two conductive contact pieces. The rear side of the sliding mechanism extends to the position below the first socket of one of the conductive contact pieces. When a plug is plugged into the first socket, one plug blade of the plug extrudes the sliding mechanism to push the two elastic piece parts, so that the two elastic piece parts can touch the conductive pieces.

As a preferred solution of the present disclosure, the anti-electric shock structure further includes an insulating shell. Guide rails that allow the sliding mechanism to slide are arranged in the insulating shell. The sliding mechanism includes a correction sliding block and an insulating pushing piece. The front side of the insulating pushing piece is pressed against the elastic piece parts. The rear side of the insulating pushing piece is pressed against the correction sliding block. The correction sliding block is arranged on the guide rails of the insulating shell in a sliding manner.

A first chute with a bottom surface inclined downward is formed in the upper end of one side, far away from the insulating pushing piece, of the correction sliding block. The first chute is correspondingly formed below the first socket. The length, extending to the position below the first socket, of the correction sliding block is equal to the distance of a gap between the elastic piece parts and the conductive pieces.

As a preferred solution of the present disclosure, a connecting hole is formed in a side wall of the insulating shell. The insulating pushing piece is arranged in a manner of penetrating through the connecting hole. The jack parts of the conductive contact pieces are arranged in the insulating shell. The elastic piece parts of the conductive contact pieces penetrate through the lower end of the side wall, provided with the connecting hole, of the insulating shell and extend to the front of the connecting hole.

A plurality of first jacks are formed in a top surface of the insulating shell. The first jacks are formed corresponding to the first sockets.

A first partition plate, a second partition plate, and a third partition plate are arranged in the insulating shell. The insulating shell is isolated into a first cavity, a second cavity, and a third cavity through the first partition plate, the second partition plate, and the third partition plate. The jack parts of the two conductive contact pieces are respectively arranged in the first cavity and the second cavity. A first water through hole is formed in each of the positions, in the first cavity, the second cavity, and the third cavity, on the bottom surface of the insulating shell.

As a preferred solution of the present disclosure, second sockets are further formed in the jack parts of the two conductive contact pieces. An intermediate contact piece used for plugging a plug ground wire is arranged between the jack parts of the two conductive contact pieces. The intermediate contact piece is arranged in the third cavity. The two second sockets and the intermediate contact piece are in triangular arrangement. The intermediate contact piece is arranged close to the correction sliding block. A second chute with a downward inclined bottom surface is formed in the upper end of one side, close to the intermediate contact piece, of the correction sliding block.

As a preferred solution of the present disclosure, one end, provided with the first chute, of the insulating pushing piece is arranged in the first cavity. One end, provided with the second chute, of the insulating pushing piece is arranged in the third cavity. One end, close to the first partition plate, of the second partition plate is pressed against the correction sliding block. One end of a side wall, close to the side wall of the insulating shell, of the second partition plate is clamped on the correction sliding block.

As a preferred solution of the present disclosure, the insulating shell includes a base plate and an upper shell. A clamping groove is formed in the base plate. The first partition plate, the second partition plate, and the third partition plate are arranged in the insulating shell. The bottom end of the upper shell is clamped in the clamping groove. A first gap is formed in the bottom end of the side wall of the upper shell. The elastic piece parts of the conductive contact pieces penetrate through the first gap and extend to the front of the upper shell. Buckles are arranged on the sides of the base plate. Clamping hooks are arranged on the side wall of the upper shell. The base plate is connected to upper shell by clamping the buckles on the clamping hooks. The first jacks are formed in the top surface of the upper shell. The plurality of the first jacks are formed corresponding to the first sockets, the second sockets and the intermediate contact piece.

As a preferred solution of the present disclosure, the insulating pushing piece includes an inner pushing piece and an outer sealing piece. The inner pushing piece includes an extruding head and a pushing head. The extruding head is connected to the pushing head through a connecting column. A clamping groove is formed between the extruding head and the pushing head. The outer sealing piece includes an external wall and an internal wall. Both the external wall and the internal wall are cylindrical. The rear end of the internal wall is protruded from the rear end of the external wall. The external wall is connected to the internal wall through a connecting wall. A convex ring that is protruded from the inner wall of the internal wall is arranged on the inner side of the internal wall. The convex ring of the outer sealing piece is clamped in the clamping groove of the inner pushing piece. The extruding head is clamped on the front side surface of the internal wall. The pushing head is clamped on the inner side wall of the internal wall, and the end surface of the pushing head and the rear side surface of the internal wall are in the same plane.

As a preferred solution of the present disclosure, a first baffle plate and a second baffle plate are arranged on the base plate. The first baffle plate and the second baffle plate are respectively arranged in the first cavity and the second cavity. The first baffle plate and the second baffle plate are respectively arranged between the first sockets and the second sockets of the two jack parts. The first through holes are respectively formed in the positions, corresponding to the first baffle plate and the second baffle plate, on the base plate in the first cavity and the second cavity. The first baffle plate and the second baffle plate respectively divide the first water through holes on two sides. A bottom frame is arranged around the periphery of each water through hole on one side, deviating from the upper shell, of the base plate.

The present disclosure further includes a socket, including the above-mentioned anti-electric shock structure, further including a base and a cover shell. The cover shell covers the base. An enclosure plate is arranged inside the cover shell. The interior of the cover shell is divided into an accommodating cavity and a wiring cavity by the enclosure plate.

The insulating shell of the anti-electric shock structure is arranged in the accommodating cavity. Mounting holes are formed in the enclosure plate. The insulating pushing piece is clamped in the mounting holes. A plurality of second gaps are formed in the bottom end of the enclosure plate. The elastic piece parts of the conductive contact pieces penetrate through the second gaps and extend into the wiring cavity. A plurality of limiting strips are arranged in the wiring cavity. The conductive pieces and the elastic piece parts of the conductive contact pieces are positioned through the limiting strips.

Second jacks are formed in the positions, corresponding to the first jacks, of the cover shell. Second water through holes are formed in the positions, corresponding to the first water through holes, of the base.

As a preferred solution of the present disclosure, a plurality of first positioning grooves are formed in the accommodating cavity of the cover shell. A plurality of second positioning grooves are formed in the base. The first positioning grooves are formed corresponding to the second positioning grooves. A plurality of insulating shells of the anti-electric shock structure are positioned in the first positioning grooves and the second positioning grooves. Connecting lugs are arranged on a side wall of the insulating shell. The insulating shell is connected to the cover shell through the connecting lugs.

Compared with the prior art, the present disclosure has the following beneficial effects:

1. The anti-electric shock structure provided by the present disclosure includes the two oppositely arranged conductive contact pieces, the sliding mechanism, and the conductive pieces corresponding to the two conductive contact pieces. Each conductive contact piece includes a jack part and an elastic piece part. The elastic piece part is connected to the front end of the jack part and can extend to the front of the jack part. In the non-conductive state, the two conductive pieces are respectively arranged in front of the elastic piece parts of the two conductive contact pieces at an interval. First sockets are formed in the jack part. The front side of the sliding mechanism is pressed against the elastic piece parts of the two conductive contact pieces. The rear side of the sliding mechanism extends the position below the first socket of one of the conductive contact pieces. When a plug is lugged into the first sockets, one plug blade of the plug extrudes the sliding mechanism to push the two elastic piece parts, so that the two elastic piece parts can touch the conductive pieces. When a metal conductive object of a non-plug pin is plugged into the first socket, the conductive contact pieces and the conductive pieces are still in a disconnected state due to the fact that the dimension of the conductive object cannot push the sliding mechanism to the position where the elastic piece parts are in contact with the conductive pieces. At this time, there is no electric shock danger no matter the metal conductive object of the non-plug pin is plugged into one first socket or is simultaneously plugged into two first sockets, so that the anti-electric shock structure has a good anti-electric shock function.

2. According to the anti-electric shock structure provided by the embodiments of the present disclosure, the first partition plate, the second partition plate, and the third partition plate are arranged in the insulating shell. The insulating shell is isolated into the first cavity, the second cavity, and the third cavity through the first partition plate, the second partition plate, and the third partition plate. The jack parts of the two conductive contact pieces are respectively arranged in the first cavity and the second cavity. First water through holes are respectively formed in the positions, in the first cavity, the second cavity, and the third cavity, on the bottom surface of the insulating shell. When the socket is electrified, when water enters both first jacks, the water is divided into the first cavity and the second cavity, and a null wire and a live wire cannot form a loop, so that the risk of short circuit/electric leakage is avoided. The first water through holes and the first jacks formed in the bottom surface of the insulating shell form independently sealed water drainage channels, and the water splashed into the first cavity and the second cavity can be instantaneously and automatically discharged from the bottom surface of the insulating shell, so that an effective waterproof effect is achieved.

BRIEF DESCRIPTION OF THE DRAWINGS

In order to more clearly illustrate the embodiments of the present disclosure or the technical solutions in the prior art, the accompanying drawings used in the description of the embodiments or the prior art will be briefly described below. It is apparent that the accompanying drawings in the following description are merely some embodiments of the present disclosure, and other accompanying drawings can also be obtained from those skilled in the art according to these accompanying drawings without any creative work.

Figure 1:
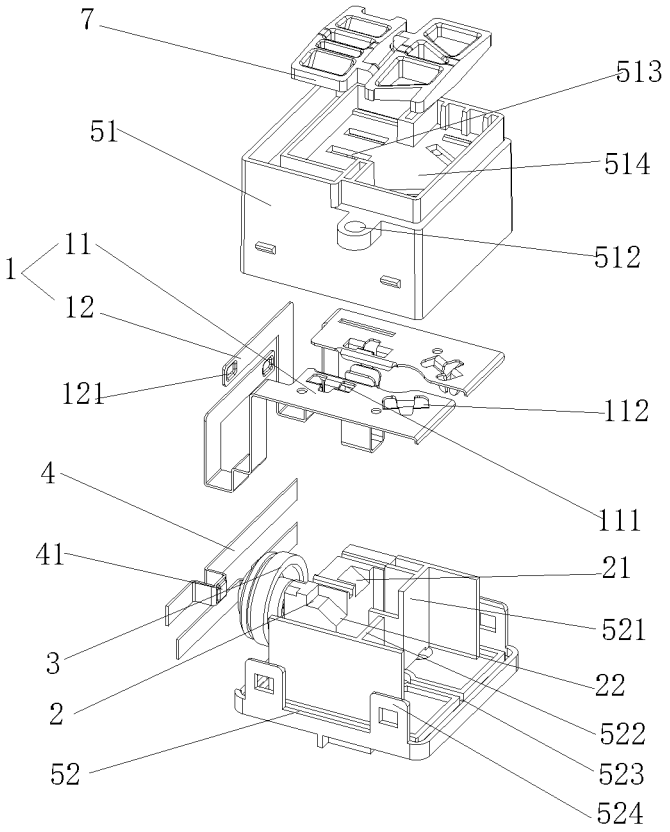
FIG. 1 is a front exploded schematic diagram one of an anti-electric shock in Embodiment 1.

Reference signs in the drawings: 1—conductive contact piece, 11—jack part, 111—first socket, 112—second socket, 12—elastic piece part, 121—first contact, 2—correction sliding block, 21—first chute, 22—second chute, 3—insulating pushing piece, 31—outer sealing piece, 311—external wall, 312—internal wall, 313—connecting wall, 314—clamping connecting groove, 315—convex ring, 32—inner pushing piece, 321—pushing head, 322—extruding head, 323—connecting column, 324—clamping groove, 4—conductive piece, 41—second contact, 5—insulating shell, 51—upper shell, 511—clamping hook, 512—connecting lug, 513—first jack, 514—groove, 515—first gap, 516—connecting hole, 52—base plate, 521—first baffle plate, 522—second baffle plate, 523—connecting groove, 524—buckle, 525—first water through hole, 526—bottom frame, 527—guide rail, 53—first partition plate, 54—second partition plate, 55—third partition plate, 56—first cavity, 57—second cavity, 58—third cavity, 6—intermediate contact piece, 61—ground wire conducting piece, 7—protective door, 8—cover shell, 81—enclosure plate, 811—mounting hole, 812—second gap, 82—accommodating cavity, 83—wiring cavity, 831—limiting strip, 84—first positioning groove, 85—second jack, 9—base, 91—second water through hole, 92—second positioning groove, and 10—switch.

DETAILED DESCRIPTION OF THE EMBODIMENTS

In the descriptions of the present disclosure, it should be noted that "a plurality of" means two or more; orientations or positional relationships indicated by terms "upper", "lower", "front", "rear", "left", "right", "top", "bottom", "inner", "outer", "front end", "rear end", "head", "tail", etc. are the orientations or positional relationships shown in the accompanying drawings, and are merely for the convenience of describing the present disclosure and simplifying, rather than indicating or implying that the devices or elements must have particular orientations, and constructed and operated in particular orientations. Thus, it cannot be construed as a limitation to the present disclosure. In addition, terms "first", "second", "third", etc. are merely used for description, and cannot be understood as indicating or implying relative importance.

In the description of the present disclosure, it should be noted that, unless otherwise specified and defined explicitly, the terms "mounted", "interconnected", and "connected" are to be interpreted broadly, may be, for example, fixedly connected, or detachably connected, or integrally connected, may be mechanically connected, or electrically connected, may be directly connected, or indirectly connected through an intermediate medium. Those of ordinary skill in the art may understand specific meanings of the above-mentioned terms in the present disclosure in specific cases.

Specific implementation manners of the present disclosure are further described below with reference to the accompanying drawings.

Embodiment 1

The embodiment provides an anti-electric shock structure, as shown in FIG. 1 to FIG. 5, including two conductive contact pieces 1 that are arranged oppositely, a sliding mechanism, and conductive pieces 4 corresponding to the two conductive contact pieces 1. Each conductive contact piece 1 includes a jack part 11 and an elastic piece part 12. The elastic piece part 12 is connected to the front end of the jack part 11 and can extend to the front of the jack part 11. In a non-conductive state, the two conductive pieces 4 are respectively arranged in front of the elastic piece parts 12 of the two conductive contact pieces at an interval. When the conductive pieces 4 are charged, the two conductive contact pieces 1 are not charged due to the fact that the elastic piece parts 12 of the two conductive contact pieces and the two conductive pieces 4 are arranged at intervals.

Figure 2:
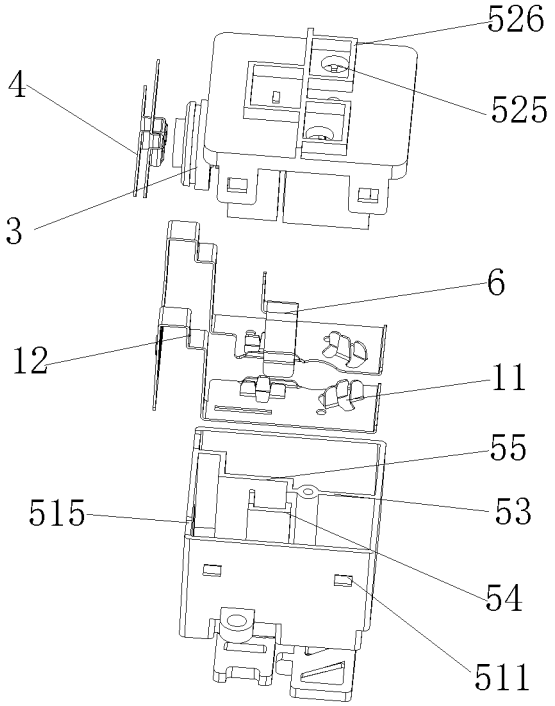
FIG. 2 is a back exploded schematic diagram of the anti-electric shock in Embodiment 1.
Figure 3:
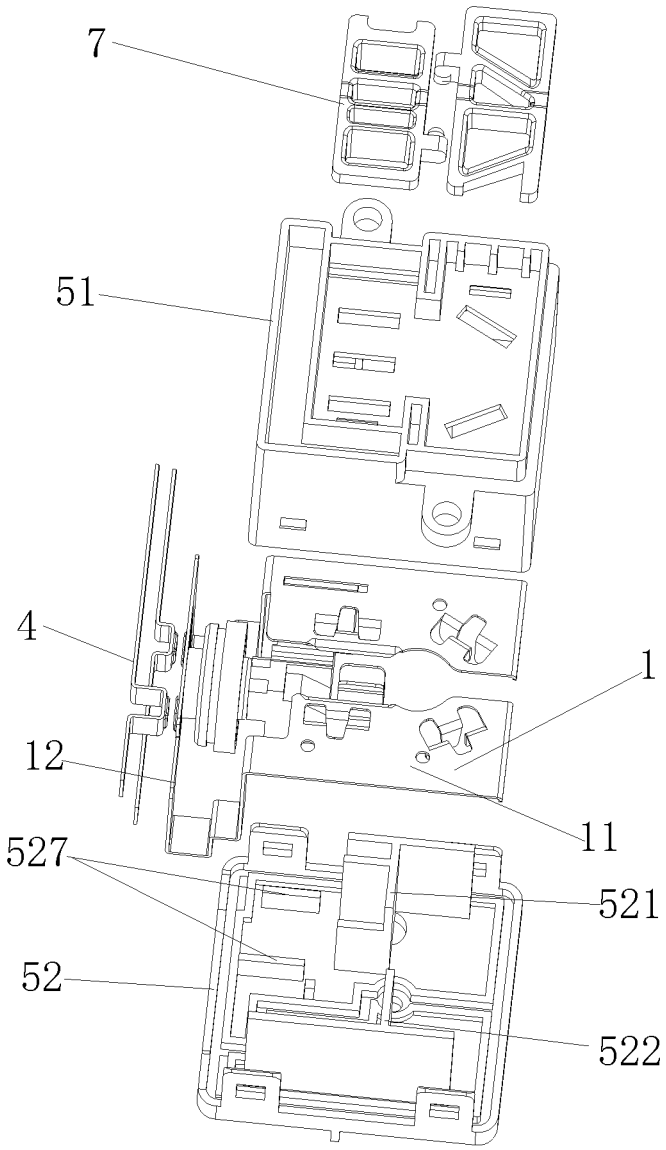
FIG. 3 is a front exploded schematic diagram two of the anti-electric shock in Embodiment 1.
Figure 4:
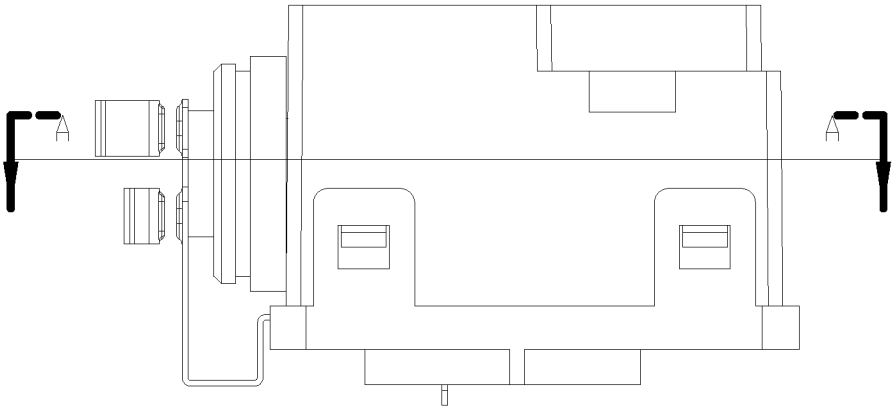
FIG. 4 is a front view of the anti-electric shock in Embodiment 1.

As shown in FIG. 1 to FIG. 3, a first socket 111 is formed in the jack part 11. The front side of the sliding mechanism is pressed against the elastic piece parts 12 of the two conductive contact pieces. The rear side of the sliding mechanism extends to the position below the first socket 111 of one of the conductive contact pieces. When a plug is plugged into the first sockets 111, one plug blade of the plug extrudes the sliding mechanism to push the two elastic piece parts 12, so that the two elastic piece parts can touch the conductive pieces 4. Preferably, the jack part 11 and the elastic piece part 12 are of an integrated into structure. The conductive contact pieces 1 and the conductive pieces 4 are all made of copper sheets. The elastic piece parts 12 of the two conductive contact pieces 1 are both of strip-shaped structures. One end of the elastic piece part 12 is connected to the front end of the jack part 11, and the other end of the elastic piece part 12 extends in the direction of the other conductive contact piece 1. The elastic piece parts 12 of the two conductive contact pieces 1 are arranged on the front side of the sliding mechanism in parallel up and down. Preferably, a first contact 121 is arranged at the free end of the elastic piece part 12, a second contact 41 is formed by bending toward the first contact at a position, corresponding to the first contact 121, of the conductive piece 4. The elastic piece part 12 is in contact with the conductive piece 4 to conduct electricity through the contact between the first contact 121 and the second contact 41.

According to the anti-electric shock structure of the embodiment, the sliding mechanism can move forward when being extruded by arranging the sliding mechanism below the first socket 111, so as to push the elastic piece parts 12 of the two conductive contact pieces 1 to be in contact with the two conductive pieces 4 simultaneously. The two conductive pieces 4 are respectively connected to a null wire and a live wire, so as to be charged. When a metal conductive object of a non-plug pin is plugged into the first socket 111, the dimension of the conductive object cannot push the sliding mechanism to the position where the elastic piece parts 12 are in contact with the conductive pieces 4, so that the conductive contact pieces 1 and the conductive pieces 4 are still in a disconnected state when the metal conductive object of a non-plug pin is plugged into the first socket 111. At this time, there is no electric shock danger no matter the metal conductive object of the non-plug pin is plugged into one first socket 111 or is simultaneously plugged into two first sockets 111, so that misplug is avoided, and the anti-electric shock structure has a good anti-electric shock function. For example, when a finger of a person is plugged into the first socket 111, the sliding mechanism cannot be pushed to make the elastic piece parts 12 be in contact with the conductive pieces 4, so that an electric shock danger is avoided. In addition, the sliding mechanism is arranged below the first socket 111, which brings difficulty to push the sliding mechanism by the conductive object of the non-plug pin. For example, the finger cannot be plugged below the first socket 111, so that the sliding mechanism cannot be pushed, and the safety of the anti-electric shock structure in the embodiment during use is guaranteed. In addition, the sliding mechanism is arranged only below one first socket 111, which also reduces the probability of pushing the sliding mechanism and reduces the possibility of electric shock.

During use, when a plug pin meeting a standard is plugged, the sliding mechanism is extruded to move forwards due to the space extrusion effect of the pin. The sliding mechanism props against the elastic piece parts 12 of the conductive contact pieces 1, and the two elastic piece parts 12 are respectively in contact with the conductive pieces 4 that are connected to the null wire and the live wire, so that conduction is realized, and the socket can be normally used. When the plug is unplugged from the anti-electric shock structure, the sliding mechanism automatically resets under the action of the elastic force of the elastic piece parts 12, and then electricity conduction is automatically disconnected, so that an anti-electric shock state is restored.

In addition, the conductive contact pieces 1 of the embodiment are uncharged when there is no plug plugged, which avoids electric energy waste, so that the anti-electric shock structure of the embodiment has high efficiency and energy saving performance. A baffle plate does not need to be arranged, so as to facilitate the plugging of the plug.

Preferably, as shown in FIG. 1 to FIG. 3, the anti-electric shock structure of the embodiment further includes an insulating shell 5. Guide rails 527 that allow the sliding mechanism to slide are arranged in the insulating shell 5. The sliding mechanism includes a correction sliding block 2 and an insulating pushing piece 3. The front side of the insulating pushing piece 3 is pressed against the elastic piece parts 12. The rear side of the insulating pushing piece 3 is pressed against the correction sliding block 2. The correction sliding block 2 is arranged on the guide rails 527 of the insulating shell in a sliding manner. The insulating pushing piece 3 is arranged between the two conductive contact pieces, and the correction sliding block 2 is arranged in a manner of biasing towards the jack part of one conductive contact piece. The guide rails 527 are arranged on the bottom surface of the insulating shell 5. A chute is formed in the bottom surface of the correction sliding block 2. The chute of the correction sliding block 2 is clamped on the guide rails 527 in a sliding manner.

a first chute 21 with a bottom surface inclined downward is formed in the upper end of one side, far away from the insulating pushing piece 3, of the correction sliding block 2. The first chute 21 is correspondingly formed below the first socket 111. When the plug is plugged into the first socket 111, the pin extrudes the first chute 21 of the correction sliding block 2 during pressing the pin downwards, so that the pin is plugged downwards easily and extrudes the correction sliding block 2 to move forwards. The length, extending to the position below the first socket 111, of the correction sliding block 2 is equal to the distance of a gap between the elastic piece parts 12 and the conductive pieces 4. Only when a standard plug is plugged into the first socket 111, the correction sliding block 2 can be fully extruded. The correction sliding block 2 moves forwards by a distance that just enables the elastic piece parts 12 to be in contact with the conductive pieces 4. When other non-plug conductive objects are plugged into the first sockets 111, the correction sliding block 2 cannot be fully extruded to realize electricity conduction, so that the anti-electric shock structure of the embodiment has a good anti-electric shock function.

Figure 6:
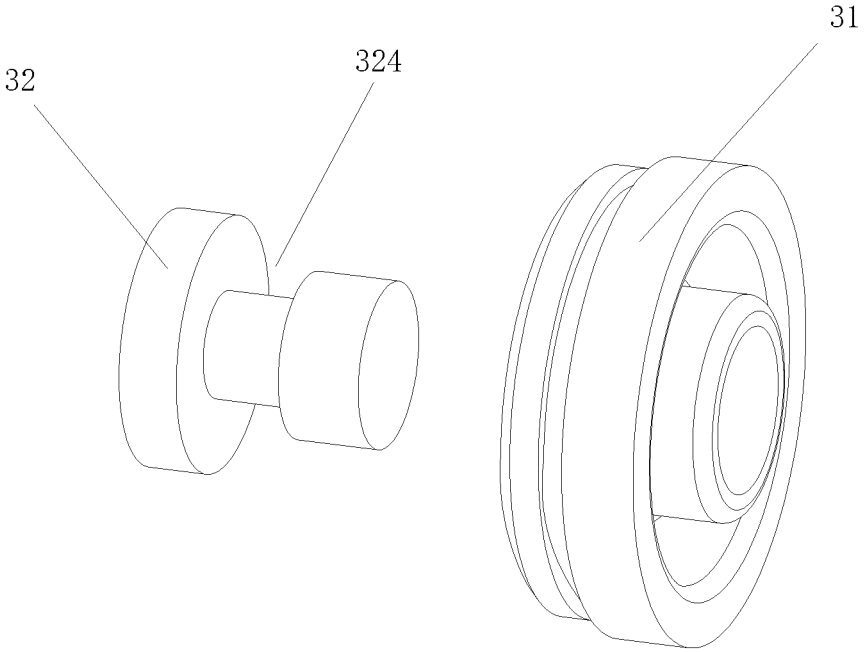
FIG. 6 is an exploded view of an insulating pushing piece.
Figure 7:
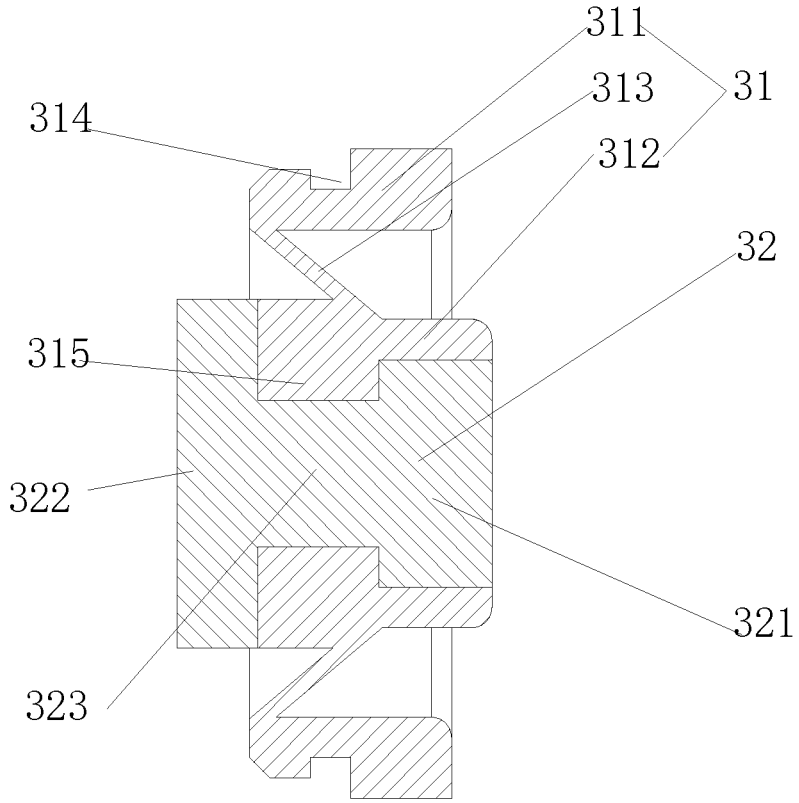
FIG. 7 is a schematic diagram of an internal structure of the insulating pushing piece.

Preferably, as shown in FIG. 6 to FIG. 7, the insulating pushing piece 3 includes an inner pushing piece 32 and an outer pushing piece 31. The inner pushing piece 32 includes an extruding head 322 and a pushing head 321. The extruding head 322 is connected to the pushing head 321 through a connecting column 323. A clamping groove 324 is formed between the extruding head 322 and the pushing head 321. The extruding head 322, the pushing head 321, and the connection columns 323 are coaxially arranged. The outer sealing piece 31 includes an external wall 311 and an internal wall 312. Both the external wall 311 and the internal wall 312 are cylindrical. The rear end of the internal wall 312 is protruded from the rear end of the external wall 311. The external wall 311 is connected to the internal wall 312 through a connecting wall 313. A convex ring 315 that is protruded from the inner wall of the internal wall 312 is arranged on the inner side of the internal wall 312. The convex ring 315 of the outer sealing piece is clamped in the clamping groove 324 of the inner pushing piece. The extruding head 322 is clamped on the front side surface of the internal wall 312. The pushing head 321 is clamped on the inner side wall of the internal wall 312, and the end surface of the pushing head 321 and the rear side surface of the internal wall 312 are in the same plane. The outer side of the internal wall 312 of the outer sealing piece 31 is arranged in a manner of penetrating through the connecting hole 516. The elastic piece parts 12 press against the front side wall of the extruding head 322 of the inner pushing piece 32. When the correction sliding block 2 extrudes the insulating pushing piece 3, the inner pushing piece 32 transfers an acting force forward and pushes the elastic piece parts 12 through the extruding head 322. The outer pushing piece 31 is made of a silica gel material, has waterproofness, has certain elasticity, and can make the inner pushing piece 32 move forwards under the acting force of the correction sliding block 2, and can also make the inner pushing piece 32 reset backwards. Preferably, the connecting wall 313 is of a conical structure with a forward opening, so that the internal wall 312 of the outer sealing piece 31 has good elastic displacement with respect to the external wall 311, thereby ensuring that the inner pushing piece 32 can move back and forth when the outer sealing piece 31 is positioned.

Figure 5:
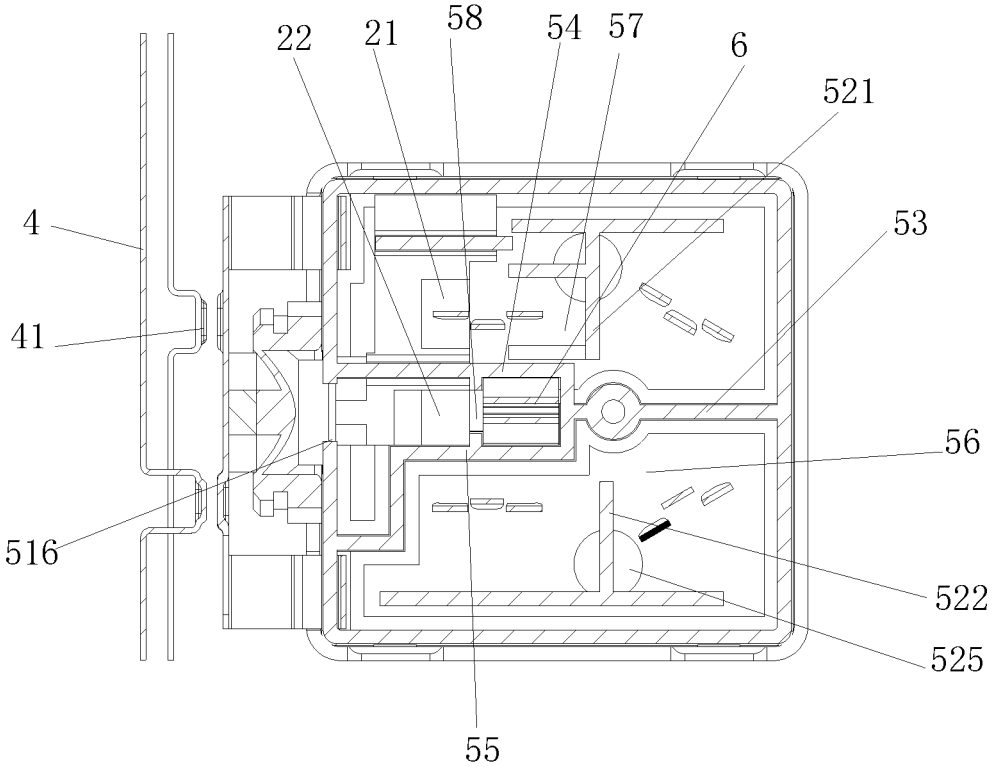
FIG. 5 is a sectional view of A-A in FIG. 4.

Preferably, as shown in FIG. 5, a connecting hole 516 is formed in a side wall of the insulating shell 5. The insulating pushing piece 3 is arranged in a manner of penetrating through the connecting hole 516. The jack parts 11 of the conductive contact pieces are arranged in the insulating shell 5. The elastic piece parts 12 of the conductive contact pieces penetrate through the lower end of the side wall, provided with the connecting hole, of the insulating shell 5 and extend to the front of the connecting hole 516. Due to the arrangement of the insulating shell 5, the jack parts 11 of the conductive contact pieces 1 are isolated from the conductive pieces 4, the space arrangement is more reasonable, and the safety performance is better.

As shown in FIG. 1, a plurality of first jacks 513 are formed in a top surface of the insulating shell 5. The first jacks 513 are formed corresponding to the first sockets 111.

As shown in FIG. 5, a first partition plate 53, a second partition plate 54, and a third partition plate 55 are arranged in the insulating housing 5. The insulating shell 5 is isolated into a first cavity 56, a second cavity 57, and a third cavity 58 through the first partition plate 53, the second partition plate 54, and the third partition plate 55. One end of each of the first partition plate 53, the second partition plate 54, and the third partition plate 55 is connected between the two conductive contact pieces 1. The other end of the each of the first partition plate 53, the second partition plate 54, and the third partition plate 55 is connected to the side wall of the insulating shell 5. The jack parts 11 of the two conductive contact pieces are respectively arranged in the first cavity 56 and the second cavity 57. A first water through hole 525 is formed in each of the positions, in the first cavity 56, the second cavity 57, and the third cavity 58, on the bottom surface of the insulating shell. When there is no plug plugged into the first jacks, the interior of the overall insulating shell 5 is not charged, so the short circuit of the anti-electric shock structure cannot be caused by splashed water. When the anti-electric shock structure is electrified, when water enters both first jacks, the water is divided into the first cavity 56 and the second cavity 57, and a null wire and a live wire cannot form a loop, so that the risk of short circuit or electric leakage is avoided. In addition, the first water through holes 525 and the first jacks formed in the bottom surface of the insulating shell form independently sealed water drainage channels, and the water splashed into the first cavity 56 and the second cavity 57 can be instantaneously and automatically discharged from the bottom surface of the insulating shell, so that an effective waterproof effect is achieved. The first water through holes 525 may be square or circular holes.

Preferably, the first water through holes 525 are of conical structures with small upper pore diameters and large lower pore diameters. The anti-electric shock structure of the embodiment adopts a principle of leaking a small amount and discharging a large amount, so that a small amount of water leaks in and a large amount of water is discharged out. The splashed water is prevented from accumulating in the insulating shell 5, and the water is smoothly discharged out of the insulating shell 5 from the first water through holes 525, so that the water accumulation is avoided, and a loop cannot be formed by the water.

Preferably, as shown in FIG. 1, second sockets 112 are further formed in the jack parts 11 of the two conductive contact pieces 1. An intermediate contact piece 6 used for plugging a plug ground wire is arranged between the jack parts 11 of the two conductive contact pieces. The intermediate contact piece 6 is arranged in the third cavity 58. The two second sockets 112 and the intermediate contact piece 6 are in triangular arrangement. The two second sockets 112 and the intermediate contact piece 6 are adapted to the plugging of a standard three-hole plug. The intermediate contact piece 6 is connected to a ground wire conducting piece 61. The third cavity 58 is also provided with an independently sealed water drainage channel. The water splashed into the third cavity 58 cannot form a loop with the water in the first cavity 56 or the second cavity 57, and can flow out from the first water through hole 525 instantaneously.

As shown in FIG. 1, the intermediate contact piece 6 is arranged close to the correction sliding block 2. A second chute 22 with a downward inclined bottom surface is formed in the upper end of one side, close to the intermediate contact piece 6, of the correction sliding block 2. When the three-hole plug is plugged, the second chute 22 can be extruded when a ground wire pin is plugged into the intermediate contact piece 6, so that the correction sliding block 2 move forwards, and then the insulating pushing piece 3 is pushed to make the elastic piece parts 12 be in contact with the conductive pieces 4 for conducting electricity. The correction sliding block 2 is not arranged below the two second sockets 112, which achieves an effect of preventing error and preventing electric shock.

Preferably, as shown in FIG. 5, one end, provided with the first chute 21, of the insulating pushing piece 3 is arranged in the first cavity 56. One end, provided with the second chute 22, of the insulating pushing piece is arranged in the third cavity 58. One end, close to the first partition plate, of the second partition plate 54 is pressed against the correction sliding block 2. One end, close to the side wall of the insulating shell 5, of the second partition plate 54 is clamped on the correction sliding block 2.

Preferably, as shown in FIG. 1 to FIG. 3, the insulating shell includes a base plate 52 and an upper shell 51. A connecting groove 523 is formed in the base plate 52. The first partition plate 53, the second partition plate 54, and the third partition plate 55 are arranged in the upper shell 51. The bottom end of the upper shell is clamped in the connecting groove 523. Part of the connecting groove 523 encloses the periphery of the base plate 52, and the other part is arranged at the positions corresponding to the bottom ends of the first partition plate 53, the second partition plate 54, and the third partition plate 55, so that the first cavity 56, the second cavity 57, and the third cavity 58 are respectively and independently isolated. A first gap 515 is formed in the bottom end of the side wall of the upper shell. The elastic piece parts 12 of the conductive contact pieces penetrate through the first gap 515 and extend to the front of the upper shell 51. Buckles 524 are arranged on the sides of the base plate 52. Clamping hooks 511 are arranged on the side wall of the upper shell 51. The base plate 52 is connected to the upper shell 51 by clamping the buckles 524 on the clamping hooks 511. The buckles 524 are arranged on the two sides of the base plate 52. Two buckles are respectively and uniformly arranged on the two sides. The first jacks 513 are formed in the top surface of the upper shell 51. The plurality of the first jacks 513 are formed corresponding to the first sockets 111, the second sockets 112, and the intermediate contact piece 6.

Preferably, as shown in FIG. 1, a groove 514 is formed in the upper side of the top surface of the upper shell 51. A protective door 7 is arranged in the groove. A plurality of through holes are formed in the protective door 7. The plurality of through holes and are formed corresponding to the plurality of first jacks 513.

Preferably, as shown in FIG. 1, a first baffle plate 521 and a second baffle plate 522 are arranged on the base plate 52. The first baffle plate 521 and the second baffle plate 522 are respectively arranged in the first cavity 56 and the second cavity 57. The first baffle plate 521 and the second baffle plate 522 are respectively arranged between the first sockets 111 and the second sockets 112 of the two jack parts 11. The first through holes 525 are respectively formed in the positions, corresponding to the first baffle plate 521 and the second baffle plate 522, on the base plate 52 in the first cavity 56 and the second cavity 57. The first baffle plate 521 and the second baffle plate 522 respectively divide the first water through holes 525 on two sides. The first baffle plate 521 and the second baffle plate 522 not only make the jack parts 11 of the conductive contact pieces 1 support thereon, but also separate the first sockets 111 from the second sockets 112, so that when a triangular plug is used, a loop cannot be formed between every two of the two sockets 112 and the intermediate contact piece 6. The water enters both first sockets 111 and second sockets 112 may flow out through the first water through holes 525. Preferably, a bottom frame 526 is arranged on one side, deviating from the upper shell 51, of the base plate 52 and encloses the periphery of each water through hole 525. The bottom frame 526 supports the insulating shell 5, which avoids that excessive water flow cannot flow out through the first water through holes 525 in time, and the bottom frame 526 also separates the water flowing out from each cavity.

Embodiment 2

Figure 8:
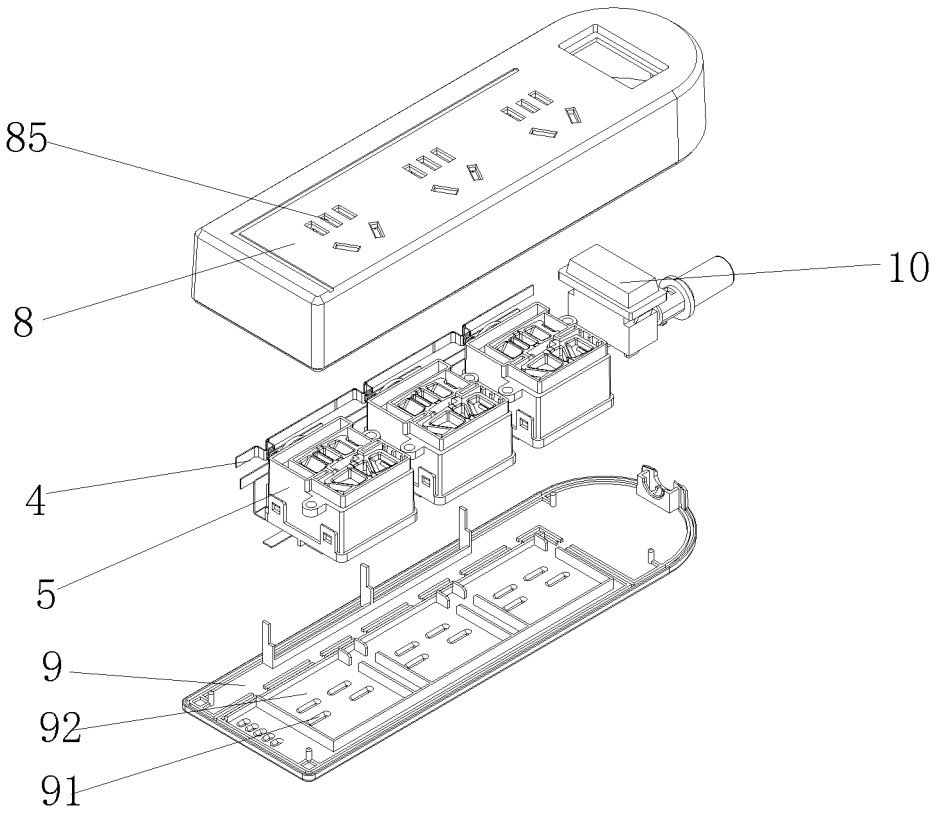
FIG. 8 is a front exploded view of a socket in Embodiment 2.
Figure 9:
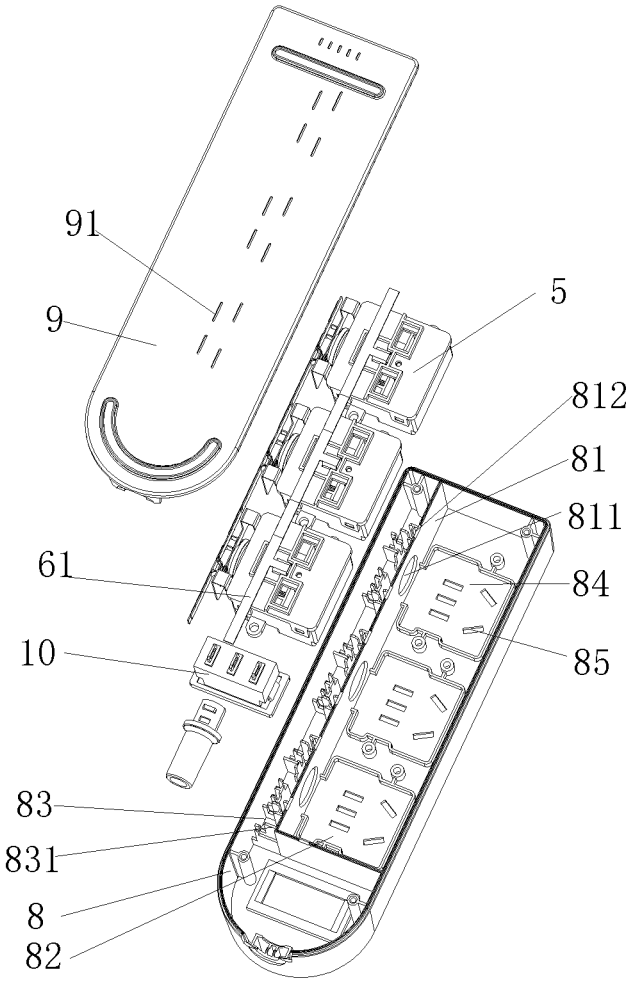
FIG. 9 is a back exploded view of the socket in Embodiment 2.

The embodiment provides a socket, as shown in FIG. 8 to FIG. 9, including the anti-electric shock structure in Embodiment 1, further including a base 9 and a cover shell 8. The cover shell 8 covers the base 9. An enclosure plate 81 is arranged inside the cover shell 8. The interior of the cover shell 8 is divided into an accommodating cavity 82 and a wiring cavity 83 by the enclosure plate 81. The wiring cavity 83 is arranged on one side of the cover shell 8. The insulating shell 5 of the anti-electric shock structure is arranged in the accommodating cavity 82. Mounting holes 811 are formed in the enclosure plate 81. The insulating pushing piece 3 is clamped in the mounting holes 811. A clamping connecting groove 314 is formed in the outer side of the external wall 311. The insulating pushing piece 3 is mounted on the enclosure plate 81 through the clamping connecting groove 314. A plurality of second gaps 812 are formed in the bottom end of the enclosure plate 81. The elastic piece parts 12 of the conductive contact pieces penetrate through the second gaps 812 and extend into the wiring cavity 83. The elastic piece parts 12 are bent downward, are bent upwards after penetrating through the first gaps 515 and the second gaps 812, and then bent to the center of the upper shell 51 at the height of the insulating pushing piece 3.

A plurality of limiting strips 831 are arranged in the wiring cavity 83. The conductive pieces 4 and the elastic piece parts 12 of the conductive contact pieces are positioned through the limiting strips 831, so as to ensure the stability of the positions of the conductive pieces 4 and the elastic piece parts 12. Second jacks 85 are formed in the positions, corresponding to the first jacks 513, of the cover shell 8. Second water through holes 91 are formed in the positions, corresponding to the first water through holes 525, of the base 9. The second water through holes 91 are strip-shaped, so as to prevent foreign matters from entering the socket. The upper pore diameter is smaller than the lower pore diameter of the second water through holes 91, so as to discharge water as soon as possible. Two second water through holes 91 are formed in the position corresponding to the ground wire conducting piece 61, so as to discharge water as soon as possible. The corresponding first through holes 525 and first through holes 525 are connected to form independent water through channels through the bottom frame 526 at the bottom of the base plate 52.

Preferably, a plurality of first positioning grooves 84 are formed in the accommodating cavity 82 of the cover shell. A plurality of second positioning grooves 92 are formed in the base 9. The first positioning grooves 84 are formed corresponding to the second positioning grooves 92. A plurality of insulating shells 5 of the anti-electric shock structure are positioned in the first positioning grooves 84 and the second positioning grooves 92. Connecting lugs 512 are arranged on a side wall of the insulating shell 5. The insulating shell 5 is connected to the cover shell 8 through the connecting lugs 512. The cover shell 8 is connected to the base 9 through a plurality of positioning columns.

Preferably, a switch 10 is arranged at one end of the socket. One end of the switch is connected to a power line, and the other end of the switch is connected to the conductive pieces 4. The switch 10 controls the charging states of the conductive pieces 4 in the socket.

The structural parts of the socket not described in the present disclosure are all the prior art.

The foregoing descriptions are merely preferred implementation manners of the present disclosure, but are not intended to limit the protection scope of the present disclosure. Any deformation and improvement may also be made by a person skilled in the art without departing from creative conception of the present disclosure, which shall fall within the protection scope of the present disclosure.

What is claimed is:

1. An anti-electric shock structure, comprising two conductive contact pieces (1) that are arranged oppositely, a sliding mechanism, and conductive pieces (4) corresponding to the two conductive contact pieces (1), wherein each conductive contact piece (1) comprises a jack part (11) and an elastic piece part (12); the elastic piece part (12) is connected to the front end of the jack part (11) and can extend to the front of the jack part (11); in a non-conductive state, the two conductive pieces (4) are respectively arranged in front of the elastic piece parts (12) of the two conductive contact pieces at intervals;

a first socket (111) is formed in the jack part (11); the front side of the sliding mechanism is pressed against the elastic piece parts (12) of the two conductive contact pieces; the rear side of the sliding mechanism extends to the position below the first socket (111) of one of the conductive contact pieces; and when a plug is plugged into the first sockets (111), one plug blade of the plug extrudes the sliding mechanism to push the two elastic piece parts (12), so that the two elastic piece parts can touch the conductive pieces (4).

2. The anti-electric shock structure according to claim 1, further comprising an insulating shell (5), wherein guide rails (527) that allow the sliding mechanism to slide are arranged in the insulating shell (5); the sliding mechanism comprises a correction sliding block (2) and an insulating pushing piece (3); the front side of the insulating pushing piece (3) is pressed against the elastic piece parts (12); the rear side of the insulating pushing piece (3) is pressed against the correction sliding block (2); the correction sliding block (2) is arranged on the guide rails (527) of the insulating shell in a sliding manner;

a first chute (21) with a bottom surface inclined downward is formed in the upper end of one side, far away from the insulating pushing piece (3), of the correction sliding block (2); the first chute (21) is correspondingly formed below the first socket (111); and the length, extending to the position below the first socket (111), of the correction sliding block (2) is equal to the distance of a gap between the elastic piece parts (12) and the conductive pieces (4).

3. The anti-electric shock structure according to claim 2, wherein a connecting hole (516) is formed in a side wall of the insulating shell (5); the insulating pushing piece (3) is arranged in a manner of penetrating through the connecting hole (516);

the jack parts (11) of the conductive contact pieces are arranged in the insulating shell (5);

the elastic piece parts (12) of the conductive contact pieces penetrate through the lower end of the side wall, provided with the connecting hole, of the insulating shell (5) and extend to the front of the connecting hole (516);

a plurality of first jacks (513) are formed in a top surface of the insulating shell (5); the first jacks (513) are formed corresponding to the first sockets (111);

a first partition plate (53), a second partition plate (54), and a third partition plate (55) are arranged in the insulating shell (5); the insulating shell (5) is isolated into a first cavity (56), a second cavity (57), and a third cavity (58) through the first partition plate (53), the second partition plate (54), and the third partition plate (55); the jack parts (11) of the two conductive contact pieces are respectively arranged in the first cavity (56) and the second cavity (57); and a first water through hole (525) is formed in each of the positions, in the first cavity (56), the second cavity (57), and the third cavity (58), on the bottom surface of the insulating shell.

4. The anti-electric shock structure according to claim 3, wherein the insulating pushing piece (3) comprises an inner pushing piece (32) and an outer sealing piece (31), wherein the inner pushing piece (32) comprises an extruding head (322) and a pushing head (321); the extruding head (322) is connected to the pushing head (321) through a connecting column (323); a clamping groove (324) is formed between the extruding head (322) and the pushing head (321); the outer sealing piece (31) comprises an external wall (311) and an internal wall (312); both the external wall (311) and the internal wall (312) are cylindrical; the rear end of the internal wall (312) is protruded from the rear end of the external wall (311); the external wall (311) is connected to the internal wall (312) through a connecting wall (313); a convex ring (315) that is protruded from the inner wall of the internal wall (312) is arranged on the inner side of the internal wall (312); the convex ring (315) of the outer sealing piece is clamped in the clamping groove (324) of the inner pushing piece; the extruding head (322) is clamped on the front side surface of the internal wall (312); and the pushing head (321) is clamped on the inner side wall of the internal wall (312), and the end surface of the pushing head (321) and the rear side surface of the internal wall (312) are in the same plane.

5. The anti-electric shock structure according to claim 3, wherein second sockets (112) are further formed in the jack parts (11) of the two conductive contact pieces (1); an intermediate contact piece (6) used for plugging a plug ground wire is arranged between the jack parts (11) of the two conductive contact pieces; the intermediate contact piece (6) is arranged in the third cavity (58); the two second sockets (112) and the intermediate contact piece (6) are in triangular arrangement; the intermediate contact piece (6) is arranged close to the correction sliding block (2); and a second chute (22) with a downward inclined bottom surface is formed in the upper end of one side, close to the intermediate contact piece (6), of the correction sliding block (2).

6. The anti-electric shock structure according to claim 5, wherein one end, provided with the first chute (21), of the insulating pushing piece is arranged in the first cavity (56); one end, provided with the second chute (22), of the insulating pushing piece is arranged in the third cavity (58); one end, close to the first partition plate, of the second partition plate (54) is pressed against the correction sliding block (2); and one end, close to the side wall of the insulating shell (5), of the second partition plate (54) is clamped on the correction sliding block (2).

7. The anti-electric shock structure according to claim 5, wherein the insulating shell comprises a base plate (52) and an upper shell (51); a connecting groove (523) is formed in the base plate (52); the first partition plate (53), the second partition plate (54), and the third partition plate (55) are arranged inside the insulating shell (5); the bottom end of the upper shell is clamped in the connecting groove (523); a first gap (515) is formed in the bottom end of the side wall of the upper shell; the elastic piece parts (12) of the conductive contact pieces penetrate through the first gap (515) and extend to the front of the upper shell (51); buckles (524) are arranged on the sides of the base plate (52); clamping hooks (511) are arranged on the side wall of the upper shell (51); the base plate (52) is connected to the upper shell (51) by clamping the buckles (524) on the clamping hooks (511); the first jacks (513) are formed in the top surface of the upper shell (51); and the plurality of the first jacks (513) are formed corresponding to the first sockets (111), the second sockets (112), and the intermediate contact piece (6).

8. The anti-electric shock structure according to claim 7, wherein a first baffle plate (521) and a second baffle plate (522) are arranged on the base plate (52); the first baffle plate (521) and the second baffle plate (522) are respectively arranged in the first cavity (56) and the second cavity (57); the first baffle plate (521) and the second baffle plate (522) are respectively arranged between the first sockets (111) and the second sockets (112) of the two jack parts (11); the first through holes (525) are respectively formed in the positions, corresponding to the first baffle plate (521) and the second baffle plate (522), on the base plate (52) in the first cavity (56) and the second cavity (57); the first baffle plate (521) and the second baffle plate (522) respectively divide the first water through holes (525) on two sides; and a bottom frame (526) is arranged on one side, deviating from the upper shell (51), of the base plate (52) and encloses the periphery of each water through hole (525).

9. A socket, comprising the anti-electric shock structure according to claim 1, further comprising a base (9) and a cover shell (8), wherein the cover shell (8) covers the base (9); an enclosure plate (81) is arranged in the cover shell (8); the interior of the cover shell (8) is divided into an accommodating cavity (82) and a wiring cavity (83) by the enclosure plate (81);

the insulating shell (5) of the anti-electric shock structure is arranged in the accommodating cavity (82); mounting holes (811) are formed in the enclosure plate (81); the insulating pushing piece (3) is clamped in the mounting holes (811); a plurality of second gaps (812) are formed in the bottom end of the enclosure plate (81); the elastic piece parts (12) of the conductive contact pieces penetrate through the second gaps (812) and extend into the wiring cavity (83); a plurality of limiting strips (831) are arranged in the wiring cavity (83); the conductive pieces (4) and the elastic piece parts (12) of the conductive contact pieces are positioned through the limiting strips (831);

second jacks (85) are formed in the positions, corresponding to the first jacks (513), of the cover shell (8); and second water through holes (91) are formed in the positions, corresponding to the first water through holes (525), of the base (9).

10. The socket according to claim 9, wherein a plurality of first positioning grooves (84) are formed in the accommodating cavity (82) of the cover shell; a plurality of second positioning grooves (92) are formed in the base (9); the first positioning grooves (84) are formed corresponding to the second positioning grooves (92); a plurality of insulating shells (5) of the anti-electric shock structure are positioned in the first positioning grooves (84) and the second positioning grooves (92); connecting lugs (512) are arranged on a side wall of the insulating shell (5); and the insulating shell (5) is connected to the cover shell (8) through the connecting lugs (512).

* * * * *